US008342716B2

(12) United States Patent
Lin

(10) Patent No.: US 8,342,716 B2
(45) Date of Patent: Jan. 1, 2013

(54) LED HEAT SINK MODULE, LED MODULE FOR LED HEAT SINK MODULE

(75) Inventor: Hsuan-Chih Lin, Yonghe (TW)

(73) Assignee: KWO GER Metal Technology, Inc., Shulin, Taipei Hsien (TW)

( * ) Notice: Subject to any disclaimer, the term of this patent is extended or adjusted under 35 U.S.C. 154(b) by 441 days.

(21) Appl. No.: 12/761,727

(22) Filed: Apr. 16, 2010

(65) Prior Publication Data

US 2010/0270922 A1 Oct. 28, 2010

(30) Foreign Application Priority Data

Apr. 28, 2009 (TW) ..... 98207142 U

(51) Int. Cl.

| | |
|---|---|
| ***H01K 1/62*** | (2006.01) |
| ***H01J 61/52*** | (2006.01) |
| ***F21V 29/00*** | (2006.01) |
| *H01K 1/30* | (2006.01) |

(52) U.S. Cl. ..... 362/294; 313/46; 313/110; 362/225

(58) Field of Classification Search ..... 313/46, 313/110; 362/225, 294

See application file for complete search history.

(56) References Cited

U.S. PATENT DOCUMENTS

| | | | | |
|---|---|---|---|---|
| 6,982,518 | B2 * | 1/2006 | Chou et al. | 313/46 |
| 7,144,135 | B2 * | 12/2006 | Martin et al. | 362/294 |
| 7,465,069 | B2 * | 12/2008 | Li | 362/294 |
| 7,699,500 | B2 * | 4/2010 | Takemoto et al. | 362/294 |
| 8,143,769 | B2 * | 3/2012 | Li | 313/46 |

* cited by examiner

*Primary Examiner* — Tracie Y Green

(74) *Attorney, Agent, or Firm* — Muncy, Geissler, Olds & Lowe, PLLC

(57) ABSTRACT

A LED head sink module includes a LED module, which comprises a circuit substrate, a LED chip installed in the circuit substrate, a packing cup molded on the circuit substrate around the LED chip and a lens molded on the packing cup over the LED chip, a heat sink, which has a base and a flat mounting block located on the bottom side of the base for stopping against the circuit substrate of the LED module for absorbing waste heat, a bracket, which has a center opening that receives the circuit substrate of the LED module, first retaining members for fastening to a retaining portion at the periphery of the packing cup and second retaining members for fastening to the flat mounting block of the heat sink, and a water seal sandwiched between the LED module and the bracket to seal off outside moisture and dust.

21 Claims, 8 Drawing Sheets

LED HEAT SINK MODULE, LED MODULE FOR LED HEAT SINK MODULE

This application claims the priority benefit of Taiwan patent application number 098207142, filed on Apr. 28, 2009.

BACKGROUND OF THE INVENTION

1. Field of the Invention

The present invention relates to light emitting technology and more particularly, to a LED heat sink module comprising a LED module, a heat sink, a bracket detachably securing the LED module to the heat sink for easy replacement of the LED module and a power control module mounted on the head sink and adapted for controlling the operation of the LED module, wherein in the LED comprises a circuit substrate, a LED chip installed in the circuit substrate, a packing cup molded on the circuit substrate around the LED chip and a lens molded on the packing cup over the LED chip.

2. Description of the Related Art

Many different lighting fixtures using different light-emitting techniques are commercially available. Nowadays, LED (light emitting diode) has been intensively used for lighting fixture for the advantages of excellent photoelectric conversion efficiency, constant wavelength, adjustability of luminous flux and light quality, small size, low heat value and long lifespan.

However, temperature affects the lifespan and stability of commercial LEDs. For example, when a high-power Ga N type LED is energized, only 20%~30% of the electric energy is converted into light energy for illumination, and the rest 70%~80% of the electric energy is converted into thermal energy that is no useful and must be expelled to the outside. When a LED, a control module and a power supply circuit are mounted inside a casing for lighting fixture, waste heat will be accumulated in the lighting fixture if no any proper heat dissipation means is used in the lighting fixture to expel heat. In this case, the LED will fail soon.

Further, when a LED, a control module, a power supply circuit and a heat sink are arranged together to form a LED heat sink module or lighting fixture, the user cannot make any change subject to individual requirements. Thus, the applicability of the LED heat sink module or lighting fixture is limited. Further, when the LED fails, the user cannot detach the LED heat sink module or lighting fixture for repair or replacement of the damaged part. This conventional design does not allow the user to change the type of the heat sink or LED to fit different requirements for color rendering, brightness and luminous efficiency. When wishing to change the color rendering, brightness or luminous efficiency, the whole unit of the LED heat sink module or lighting fixture must be taken away. Purchasing a total new unit of LED heat sink module or lighting fixture to replace an old LED heat sink module or lighting fixture is expensive and not economic.

Further, commercial lighting fixtures are not waterproof. When used outdoors, water, moisture or dust may pass to the inside, causing short circuit damage or electric leakage.

Therefore, it is desirable to provide a LED module/LED heat sink module that eliminates the aforesaid problems.

SUMMARY OF THE INVENTION

The present invention has been accomplished under the circumstances in view. It is one object of the present invention to provide a LED heat sink module, which is easily quickly detachable for allowing replacement or change of the parts to fit different operation requirements without affecting the structural stability and operational reliability.

It is another object of the present invention to provide a LED heat sink module, which effectively seals off outside moisture and dust.

It is still another object of the present invention to provide a LED heat sink module, which dissipates waste heat rapidly during operation, avoiding accumulation of waste heat and prolonging the lifespan of the module.

It is still another object of the present invention to provide a LED module for LED heat sink module, which enables the light emitted by the LED chip to pass directly through the lens, avoiding refraction, total reflection or attenuation of light and enhancing the total luminous flux and assuring uniform distribution of light.

To achieve these and other objects of the present invention, a LED heat sink module comprises a LED module, a heat sink, which has a base and a flat mounting block located on the bottom side of the base for stopping against the circuit substrate of the LED module for absorbing waste heat, and bracket, which has a center opening that receives the circuit substrate of the LED module, first retaining members for fastening to a retaining portion at the periphery of the packing cup and second retaining members for fastening to the flat mounting block of the heat sink. Thus, the user can conveniently detach the LED module from the heat sink for a replacement.

Further, a water seal is sandwiched between the LED module and the bracket to seal off outside moisture and dust.

Further, the LED module comprises a circuit substrate, a LED chip installed in the circuit substrate, a packing cup molded on the circuit substrate around the LED chip and a lens molded on the packing cup over the LED chip. When the LED module is fastened to the heat sink by the bracket, the circuit substrate is inserted through the center opening of the bracket and stopped against the bottom contact face of the flat mounting block of the heat sink for quick transfer of waste heat from the LED chip to the heat sink for quick dissipation.

Further, because the lens is molded on the packing cup over the LED chip through a secondary packaging process (by over molding), no any gap is left between the packing cup and the lens. Thus, the emitted light from the LED chip passes directly through the lens, avoiding refraction, total reflection or attenuation.

DETAILED DESCRIPTION OF THE PREFERRED EMBODIMENT

Figure 1:
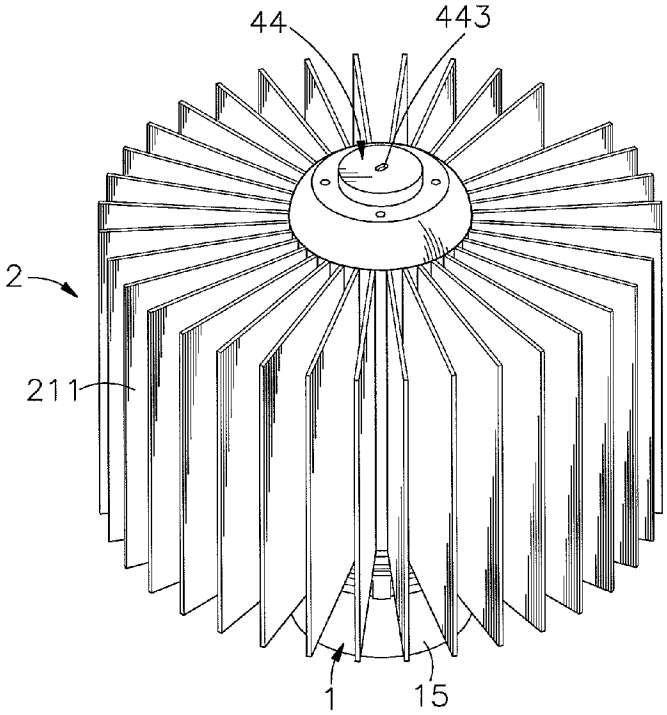
FIG. 1 is an oblique top elevation of a LED heat sink module in accordance with the present invention.
Figure 2:
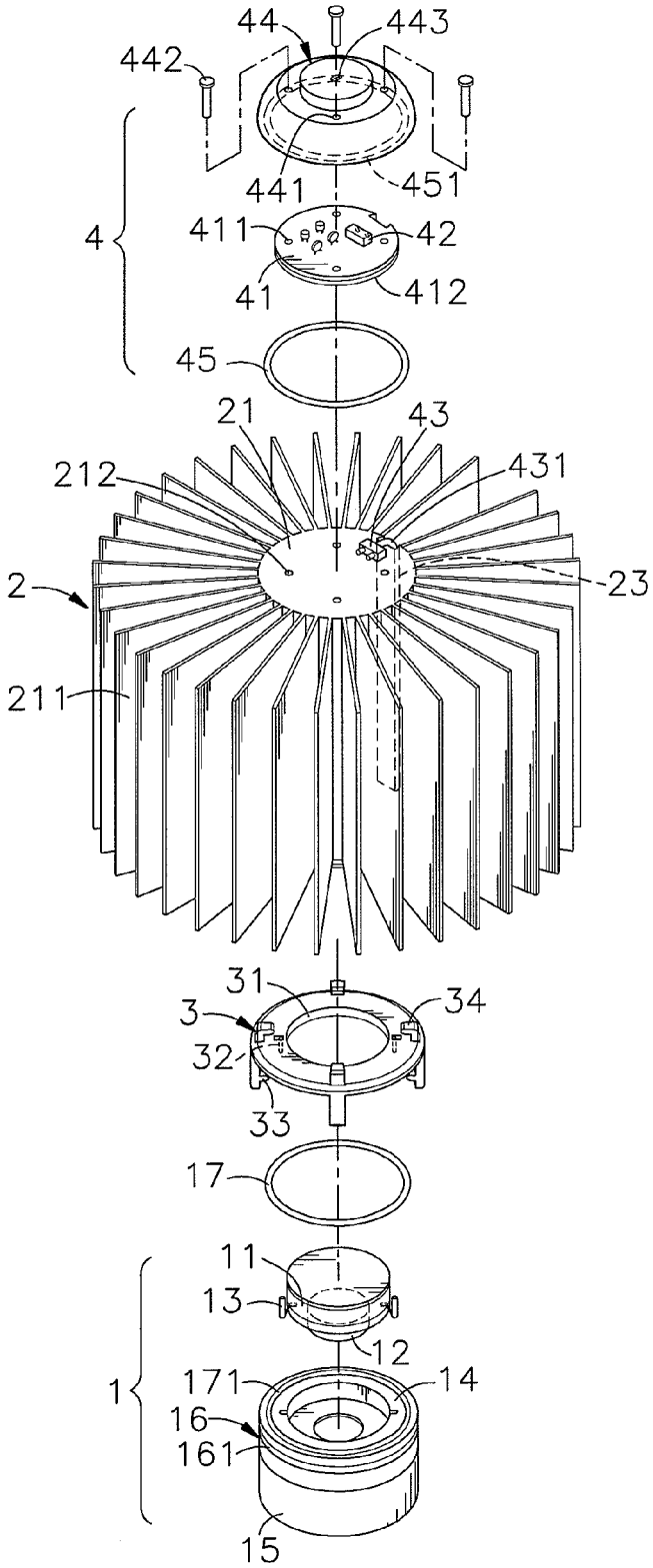
FIG. 2 is an exploded view of the LED heat sink module in accordance with the present invention.
Figure 3:
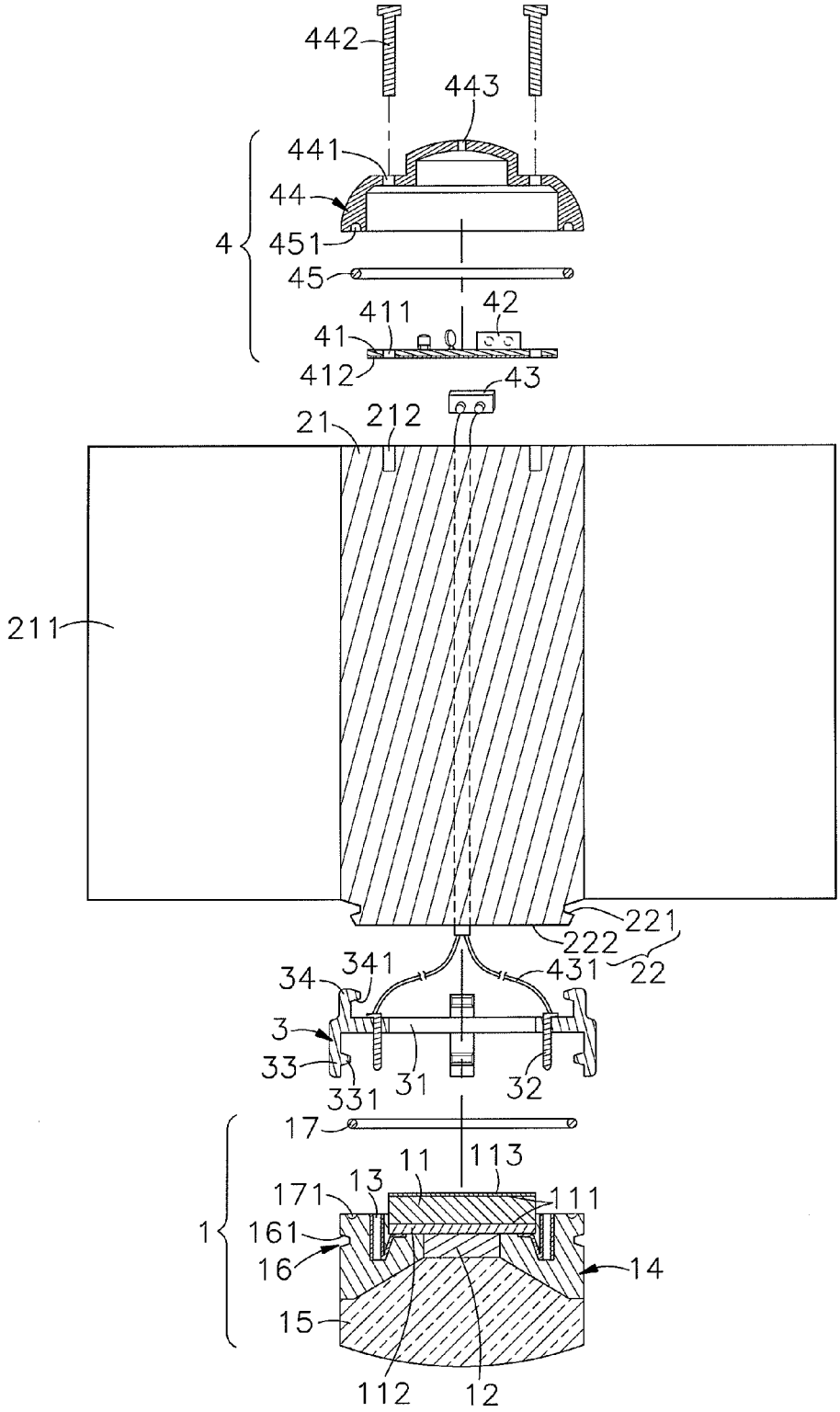
FIG. 3 is a sectional exploded view of the LED heat sink module in accordance with the present invention.
Figure 4:
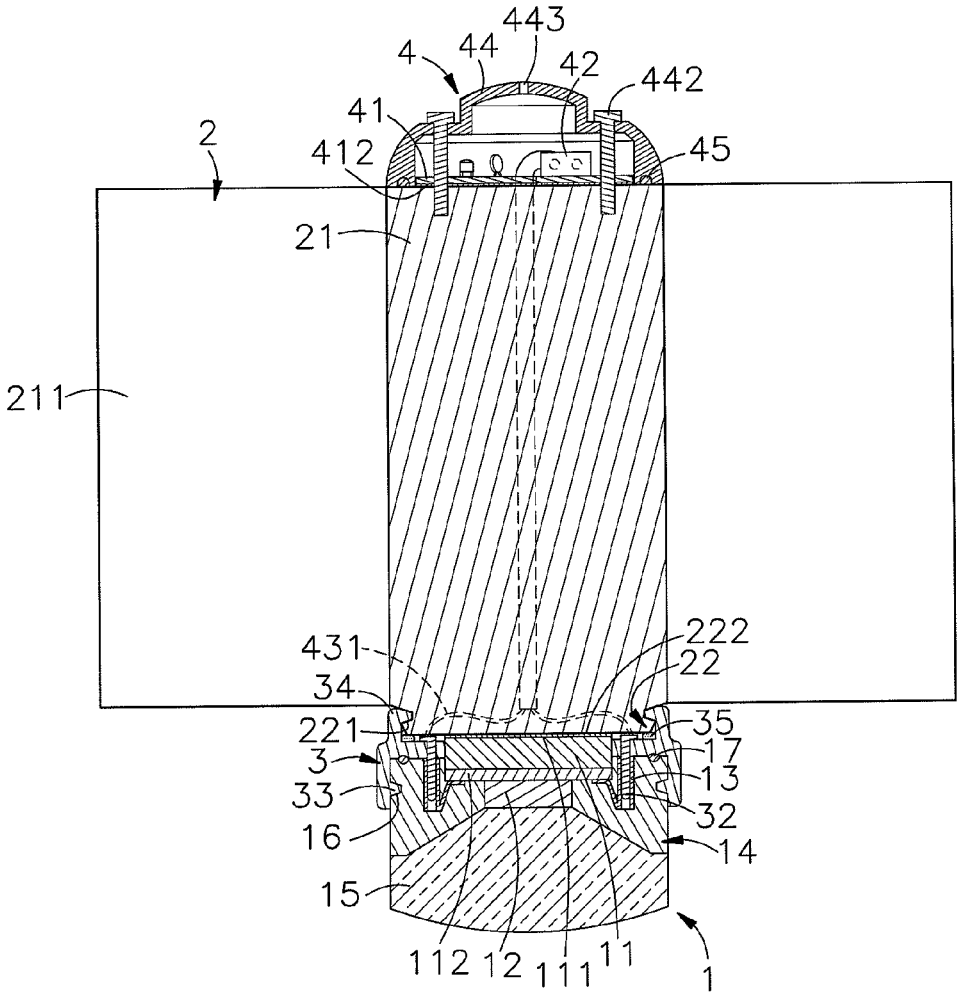
FIG. 4 is a sectional assembly view of the LED heat sink module in accordance with the present invention.
Figure 5:
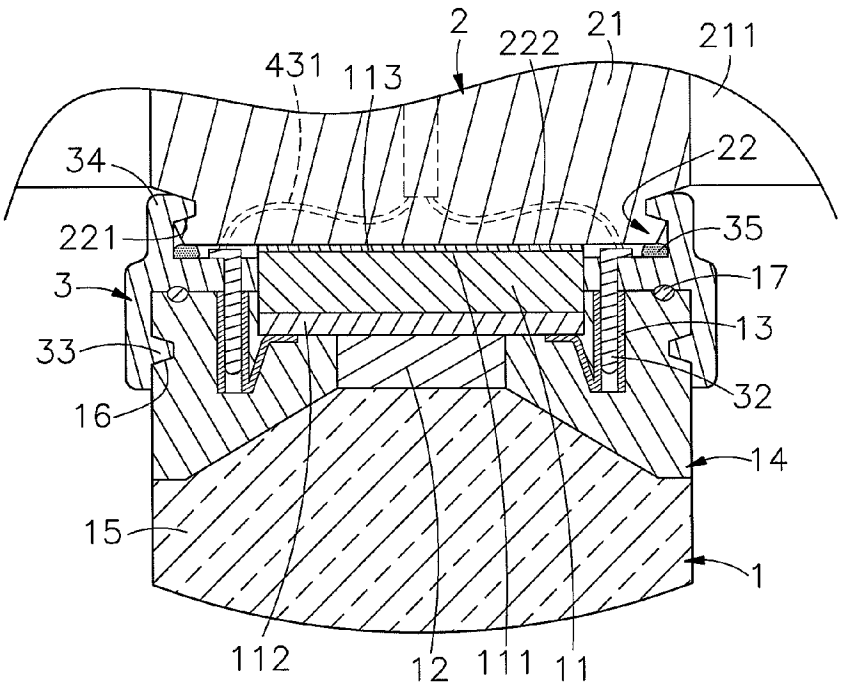
FIG. 5 is an enlarged view of a part of FIG. 4.

Referring to FIGS. 1~5, a LED heat sink module in accordance with the present invention is shown comprising a LED module 1, a heat sink 2, a bracket 3 and a power control module 4.

The LED module 1 comprises a circuit substrate 11, which has two opposing bearing walls 111 and a circuit layer 112 prepared subject to a predetermined circuit layout and located on one bearing wall 111, at least one LED (light emitting diode) chip 12 installed in the circuit layer 112, a plurality of, for example, two tubular conducting terminals 13 electrically connected to the LED chip 12 and suspending at two opposite sides of the circuit substrate 11, a packing cup 14 directly molded on the circuit substrate 11 by means of over molding for enabling the LED chip 12 and the tubular conducting terminals 13 to be exposed to the outside, and a lens 15 molded on the packing cup 14 over the LED chip 12 through a secondary packaging process (by over molding). The packing cup 14 has an endless locating groove 171 located on the bottom wall thereof around the circuit substrate 11, and a retaining portion 16, for example, a retaining groove 161 extending around the periphery thereof. Further, a water seal ring 17 is positioned in the endless locating groove 171.

The heat sink 2 comprises a cylindrical base 21 set in vertical, a through hole 23 axially extending through the top and bottom ends of the cylindrical base 21 at an eccentric location, a plurality of radiation fins 211 spaced around the periphery of the cylindrical base 21, a flat mounting block 22 located on the bottom end of the cylindrical base 21, a retaining groove 221 extending around the periphery of the flat mounting block 22, and a flat contact face 222 located on the bottom side of the flat mounting block 22 opposite to the cylindrical base 21.

The bracket 3 has a center opening 31 cut through the top and bottom sides thereof and adapted for accommodating the circuit substrate 11 of the LED module 1, at least three first retaining members 33 downwardly extended from the bottom wall thereof and equiangularly spaced around the center opening 31, and at least three second retaining members 34 upwardly extended from the top wall thereof and equiangularly spaced around the center opening 31. The first retaining members 33 and the second retaining members 34 each have a springy hooked portion 331 or 341 near the respective distal end and adapted for hooking in the retaining groove 161 at the packing cup 14 of the LED module 1 and the retaining groove 221 at the flat mounting block 22 of the heat sink 2 respectively. Thus, the bracket 3 can secure the LED module 1 and the heat sink 2 firmly together. Further, positive and negative electrodes 32 are mounted in the bracket 3 at two opposite lateral sides relative to the center opening 31.

The power control module 4 comprises a control circuit board 41 carrying a plurality of electronic components, a first electrical connector 42 installed in the control circuit board 41, a second electrical connector 43 detachably connectable to the first electrical connector 42 and having positive and negative electrical wires 431 thereof inserted through the through hole 23 of the heat sink 2 and respectively electrically connected to the positive and negative electrodes 32 at the bracket 3, a cover shell 44 capped on the top end of the cylindrical base 21 of the heat sink 2 over the control circuit board 41 and the electronic components and first electrical connector 42 at the control circuit board 41, and a water seal ring 45 mounted in a locating groove 451 on the bottom edge of the cover shell 44 and stopped between the cover shell 44 and the cylindrical base 21 of the heat sink 2 to seal off outside moisture.

The circuit substrate 11 of the LED module 1 can be a copper-based high conduction substrate, aluminum-based high conduction substrate, ferrite-based high conduction substrate or ceramics base copper-clad high conduction substrate. The LED chip 12 can be a high-power LED chip, low-power LED chip or color LED chip bonded to the circuit layer 112 at the circuit substrate 11 by means of SMT or through-hole mounting method and accommodated in the packing cup 14. After installation of the LED chip 12 in the circuit layer 112 at the circuit substrate 11, the LED chip 12 is electrically connected to the conducting terminals 13. Further, a thermal pad 113 is tightly sandwiched between the bearing wall 111 of the circuit substrate 11 opposite to the circuit layer 112 and the flat contact face 222 of the flat mounting block 22 of the heat sink 2 and another thermal pad 412 is tightly sandwiched between the bottom wall of the control circuit board 41 of the power control module 4 and the top end of the cylindrical base 21 of the heat sink 2 for quick transfer of waste heat from the LED chip 12 of the LED module 1 and the control circuit board 41 of the power control module 4 to the head sink 2 for quick dissipation into air.

During installation of the LED heat sink module, fasten the bracket 3 and the heat sink 2 together by: attaching the bracket 3 to the mounting block 22 of the heat sink 2 to force the springy hooked portions 341 of the second retaining members 34 of the bracket 3 into engagement with the retaining groove 221 at the flat mounting block 22 of the heat sink 2, and then applying a waterproof adhesive, for example, silicone adhesive 35 to the inside of the bracket 3 to seal off the gap in between the bracket 3 and the heat sink 2 against outside moisture and dust.

Thereafter, fasten the bracket 3 to the LED module 1 by: forcing the springy hooked portions 331 of the first retaining members 33 of the bracket 3 into engagement with the retaining groove 161 at the packing cup 14 of the LED module 1 and simultaneously fitting the positive and negative electrodes 32 at the bracket 3 into the tubular conducting terminals 13 at the circuit substrate 11 of the LED module 1 tightly. At this time, one bearing wall 111 of the circuit substrate 11 is inserted into the center opening 31 of the bracket 3 and stopped against the flat contact face 222 of the flat mounting block 22 of the heat sink 2, and the water seal ring 17 that is positioned in the endless locating groove 171 is squeezed in between the LED module 1 and the bracket 3 to prohibit entrance of outside moisture and dust from entering the packing cup 14.

According to the aforesaid embodiment, the first retaining members 33 and second retaining members 34 of the bracket 3 are respectively hooked in the retaining portion 16 (i.e., retaining groove 161) of the packing cup 14 of the LED module 1 and the retaining groove 221 of the flat mounting block 22 of the heat sink 2. However, this mounting arrangement is not a limitation. For example, screws can be inserted through respective mounting through holes on the first retaining members 33 and second retaining members 34 of the bracket 3 and threaded into the retaining portion 16 of the packing cup 14 of the LED module 1 and the flat mounting block 22 of the heat sink 2 to affix the LED module 1 and the heat sink 2 together.

The power control module 4 is fixedly mounted on the top end of the cylindrical base 21 of the heat sink 2. The cover shell 44 has a plurality of equiangularly spaced mounting through holes 441. The control circuit board 41 also has a plurality of mounting through holes 411 corresponding to the equiangularly spaced mounting through holes 441 of the cover shell 44. Fastening members, for example, screws 442 are respectively inserted through the equiangularly spaced mounting through holes 441 of the cover shell 44 and the mounting through holes 411 of the control circuit board 41 and driven into respective mounting holes 212 on the top end of the cylindrical base 21 of the heat sink 2 to affix the power control module 4 to the cylindrical base 21 of the heat sink 2. Further, before fixation of the power control module 4 to the heat sink 2, the second electrical connector 43 is electrically connected to the first electrical connector 42 at the control circuit board 41 and the electrical wires 431 of the second electrical connector 43 are inserted through the through hole 23 of the heat sink 2 and respectively electrically connected to the positive and negative electrodes 32 at the bracket 3. After fixation of the power control module 4 to the heat sink 2, the water seal ring 45 is squeezed in between the cover shell 44 of the power control module 4 and the cylindrical base 21 of the heat sink 2 to seal off outside moisture and dust. Further, the cover shell 44 can be made having a power jack 443 at the center and electrically connected to the control circuit board 41 of the power control module 4 for the connection of an external power cord from an external power source to provide the necessary working voltage to the control circuit board 41 of the power control module 4.

After installation of the LED heat sink module, the LED chip 12 is electrically connected to the control circuit board 41 of the power control module 4 through the positive and negative electrodes 32, the electrical wires 431, the second electrical connector 43 and the first electrical connector 42, and therefore the power control module 4 can control the operation of the LED chip 12. Further, because the LED chip 12 is accommodated in the packing cup 14 and the lens 15 is directly molded on the packing cup 14 over the LED chip 12 through a secondary packaging process, no any gap is left between the packing cup 14 and the lens 15, light emitted by the LED chip 12 passes directly through the lens 15, avoiding refraction, total reflection or attenuation. Therefore, the invention greatly enhances the total luminous flux and assures uniform distribution of light.

Further, as stated above, one bearing wall 111 of the circuit substrate 11 is stopped against the flat contact face 222 of the flat mounting block 22 of the heat sink 2. Thus, waste heat produced during operation of the LED module 1 is rapidly transferred from the circuit substrate 11 through the flat mounting block 22 to the cylindrical base 21 and then effectively and rapidly dissipated into air through the radiation fins 211, avoiding heat accumulation in the LED module 1 to affect normal functioning or to shorten the lifespan of the LED and heat sink module.

Further, the LED module 1 is detachably fastened to the heat sink 2 by the bracket 3. If the LED module 1 failed after a long use, the LED module 1 can be detached from the heat sink 2 for a replacement conveniently. This detachable arrangement facilitates change or replacement of the LED module 1 or the heat sink 2. For example, a different LED module of the same design but having a different color rendering index can be selectively used and fastened to the heat sink 2 to replace the originally used LED module 1.

Further, the heat sink 2 can be made in any of a variety of other different forms or configurations. Further, the heat sink 2 can be prepared from copper, aluminum, graphite or any other thermally conductive materials that provide high thermal conductivity for quick dissipation of absorbed heat into outside air.

Figure 6:
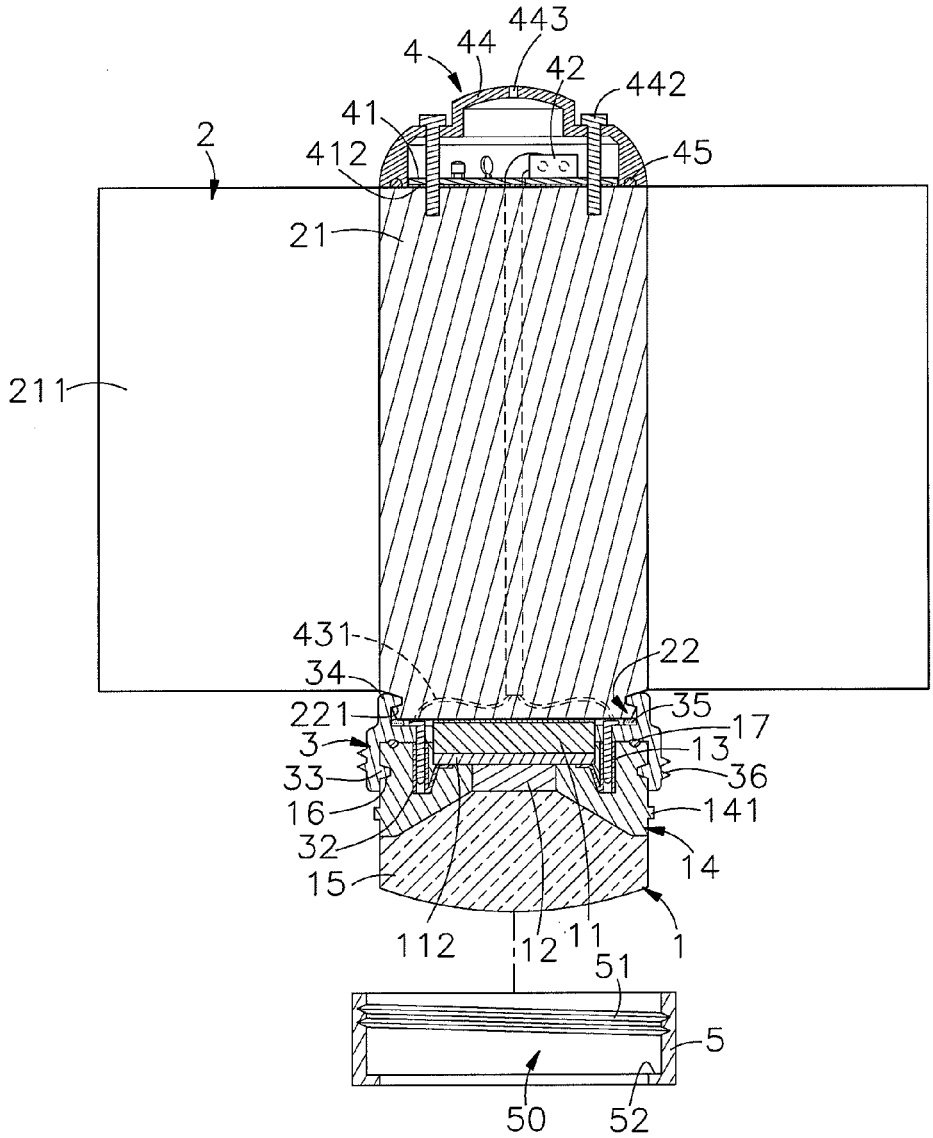
FIG. 6 is a sectional view of an alternate form of the LED heat sink module in accordance with the present invention before installation of the barrel-like hold-down member.
Figure 7:
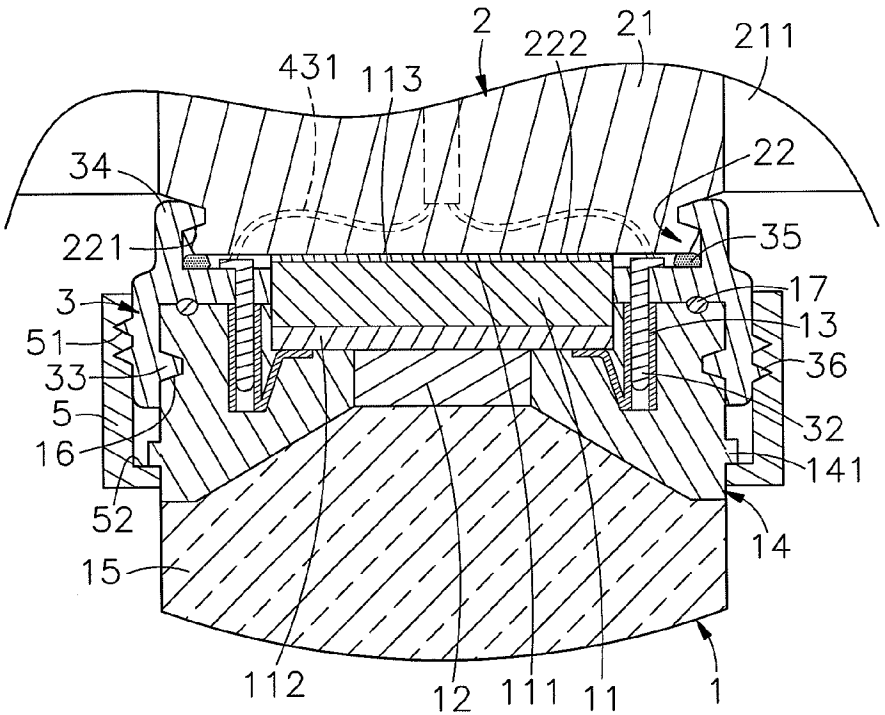
FIG. 7 is a schematic sectional partial view of the alternate form of the LED heat sink module in accordance with the present invention, showing the barrel-like hold-down member fastened to the LED module and the bracket.

FIGS. 6 and 7 show an alternate form of the present invention. According to this alternate form, a barrel-like hold-down member 5 is fastened to the periphery of the packing cup 14 of the LED module 1 and the periphery of the bracket 3 to hold down the engagement structure between the bracket 3 and the LED module 1. The barrel-like hold-down member 5 has a center opening 50, a female engagement portion 51 located on the inside wall thereof around the center opening 50 and an inside annular stop flange 52 radially inwardly protruded from the inside wall and suspending at the bottom side of the center opening 50 below the female engagement portion 51. Further, the packing cup 14 has a rib 141 protruded from and extending around the periphery below the elevation of the retaining groove 161. Further, the bracket 3 has a male engagement portion 36 located on the periphery. After connection between the bracket 3 and the LED module 1, the barrel-like hold-down member 5 is sleeved onto the LED module 1 and the bracket 3 and then rotated through an angle to force the female engagement portion 51 into engagement with the male engagement portion 35, enabling the inside annular stop flange 52 to be stopped against the rib 141 at the bottom side. Thus, the barrel-like hold-down member 5 holds down the engagement between the first retaining members 33 of the bracket 3 and the retaining portion 16 (retaining groove 161) of the packing cup 14 of the LED module 1 and the engagement between the second retaining members 34 of the bracket 3 and the flat mounting block 22 of the heat sink 2, enhancing connection stability between the LED module 1 and the bracket 3 and the connection stability between the heat sink 2 and the bracket 3. Further, the female engagement portion 51 can be an inner thread, and the male engagement portion 35 can be an outer thread for mesh with the inner thread of the female engagement portion 51. Alternatively, the female engagement portion 51 can be a groove, and the male engagement portion 35 can be a tooth for engaging the groove of the female engagement portion 51. However, it is to be understood that the aforesaid engagement structure between the barrel-like hold-down member 5 and the bracket 3 is not a limitation.

Figure 8:
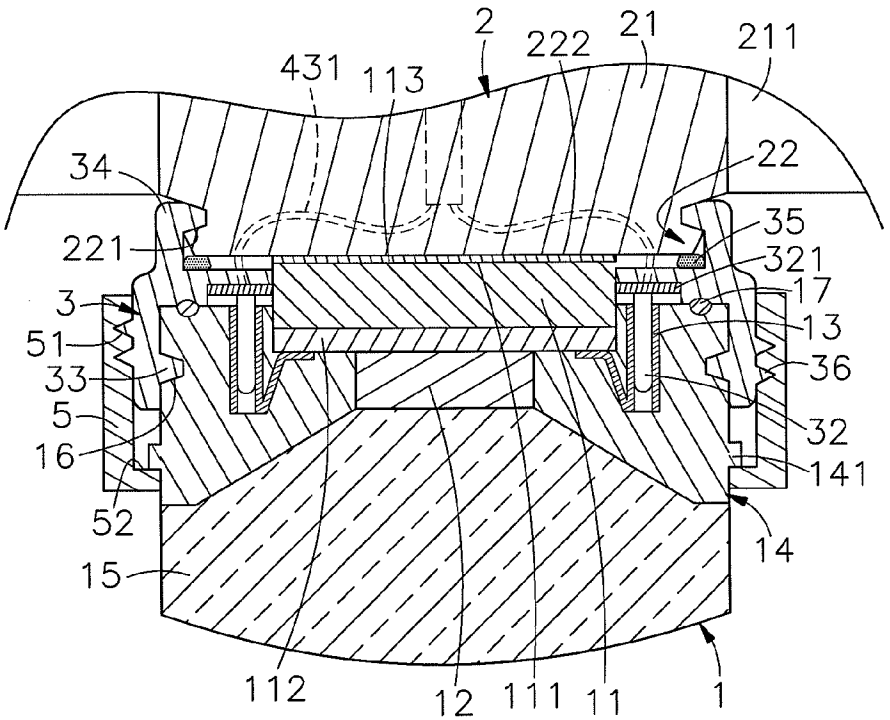
FIG. 8 is a schematic sectional view of another alternate form of the LED heat sink module in accordance with the present invention.

FIG. 8 shows another alternate form of the present invention. According to this alternate form, the bracket 3 carries an annular circuit board 321 around the center opening 31, and the positive and negative electrodes 32 are electrically soldered to the annular circuit board 321 through a through-hole mounting technique. The annular circuit board 321 is kept spaced from the flat mounting block 22 of the heat sink 2 at a distance, avoiding direct contact between the positive and negative electrodes 32 and the heat sink 2 to cause a short circuit.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A LED heat sink module, comprising:

a LED module, said LED module comprising a circuit substrate, said circuit substrate having opposing first and second bearing walls, at least one LED chip installed in said first bearing wall of said circuit substrate, a packing cup molded on said circuit substrate around said at least one LED chip, said packing cup having a retaining portion located on the periphery thereof, and a lens molded on said packing cup over said at least one LED chip;

a heat sink adapted for dissipating waste heat from said LED module, said heat sink comprising a base and a flat mounting block located on a bottom side of said base, said flat mounting block having a flat contact face adapted for stopping against said second bearing wall of said circuit substrate of said LED module; and a bracket adapted for securing said LED module to said head sink, said bracket comprising a center opening for receiving said circuit substrate of said LED module, a plurality of first retaining members equiangularly spaced around a bottom side thereof and adapted for securing said retaining portion of said packing cup and a plurality of second retaining members equiangularly spaced around a top side thereof and adapted for securing said flat mounting block of said heat sink.

2. The LED heat sink module as claimed in claim 1, wherein said LED module further comprises a plurality of conducting terminals electrically connected to said at least one LED chip and suspending at two opposite sides of said circuit substrate; said bracket carries a plurality of electrodes adapted for connecting said conducting terminals electrically; said heat sink carries a power control module electrically connectable to said conducting terminals and adapted for controlling the operation of said at least one LED chip of said LED module.

3. The LED heat sink module as claimed in claim 2, wherein said heat sink has a through hole cut through said base and said flat mounting block; said power control module comprises a control circuit board, a first electrical connector installed in said control circuit board, a second electrical connector detachably connectable to said first electrical connector and having positive and negative electrical wires thereof inserted through the through hole of said heat sink and respectively electrically connected to said positive and negative electrodes at said bracket.

4. The LED heat sink module as claimed in claim 3, wherein said heat sink comprises a plurality of mounting holes located on a top side of the base thereof opposite to said flat mounting block; said control circuit board of said power control module has a plurality of mounting through holes corresponding to the mounting holes of said base of said heat sink; said power control module further comprises a cover shell capped on said base of said heat sink over said control circuit board and said first electrical connector, said cover shell comprising a locating groove on a bottom edge thereof and a plurality of mounting through holes corresponding to the mounting through holes of said control circuit board, a water seal ring mounted in said locating groove of said cover shell and stopped between said cover shell and said base of said heat sink, and a plurality of fastening members respectively inserted through the mounting through holes of said cover shell and the mounting through holes of said control circuit board and driven into the mounting holes on the top side of said base of said heat sink to affix said cover shell to said heat sink.

5. The LED heat sink module as claimed in claim 1, wherein said retaining portion of said packing cup is a retaining groove extending around the periphery of said packing cup; each said first retaining member of said bracket comprises a hooked portion for hooking in said retaining groove of said retaining portion of said packing cup.

6. The LED heat sink module as claimed in claim 1, wherein said packing cup comprises an endless locating groove located on a bottom wall thereof around said circuit substrate, and a water seal ring positioned in said endless locating groove for stopping against said bracket.

7. The LED heat sink module as claimed in claim 1, wherein said circuit substrate further comprises a thermal pad covered on the second bearing wall thereof and adapted for stopping against the flat contact face of said flat mounting block of said heat sink.

8. The LED heat sink module as claimed in claim 1, wherein said heat sink further comprises a plurality of radiation fins radially extended from the periphery of said base, and a retaining groove extending around the periphery of said flat mounting block; each said second retaining member of said bracket comprises a hooked portion for hooking in the retaining groove at the periphery of said flat mounting block.

9. The LED heat sink module as claimed in claim 1, further comprising a waterproof adhesive applied to the space between said bracket and said heat sink.

10. The LED heat sink module as claimed in claim 1, wherein said LED module further comprises a barrel-like hold-down member fastenable to the periphery of said packing cup and the periphery of said bracket to hold down the connection between the first retaining members of said bracket and the retaining portion of said LED module and the connection between the second retaining members of said bracket and the flat mounting block of said heat sink, said barrel-like hold-down member comprising a center opening, a female engagement portion located on an inside wall around the center opening thereof and an inside annular stop flange radially inwardly protruded from the inside wall and suspending at a bottom side of the center opening below said female engagement portion; said packing cup comprises a rib protruded from and extending around the periphery thereof for stopping against the inside annular stop flange of said barrel-like hold-down member; said bracket comprises a male engagement portion located on the periphery thereof for engagement with the female engagement portion of said barrel-like hold-down member.

11. The LED heat sink module as claimed in claim 10, wherein said female engagement portion of said barrel-like hold-down member is an inner thread, and said male engagement portion of said bracket is an outer thread for mesh with the inner thread of said female engagement portion.

12. The LED heat sink module as claimed in claim 10, wherein said female engagement portion of said barrel-like hold-down member is a groove, and said male engagement portion of said bracket is a tooth for engaging the groove of said female engagement portion.

13. The LED heat sink module as claimed in claim 1, wherein said at least one LED chip is selected from a group consisting of high-power LED chips, low-power LED chips and color LED chips, and bonded to said circuit substrate by means of surface mount technology.

14. The LED heat sink module as claimed in claim 1, wherein said circuit substrate of said LED module is selected from a group consisting of copper-based high conduction substrate, aluminum-based high conduction substrate, ferrite-based high conduction substrate and ceramics base copper-clad high conduction substrate.

15. The LED heat sink module as claimed in claim 1, wherein said heat sink is prepared from a thermally conductive material selected from the group consisting of copper, aluminum and graphite.

16. A LED module, comprising:

a circuit substrate, said circuit substrate having two opposing bearing walls;

a plurality of tubular conducting terminals fixedly fastened to said circuit substrate for connection to an external power source;

at least one LED chip installed in one said bearing wall of said circuit substrate and electrically connected to said tubular conducting terminals;

a packing cup molded on said circuit substrate around said at least one LED chip, said packing cup having a retaining portion located on the periphery thereof; and a lens molded on said packing cup over said at least one LED chip.

17. The LED module as claimed in claim 16, further comprising a bracket fastened to said packing cup and adapted for securing said LED module to an external head sink, said bracket comprising a center opening for receiving said circuit substrate, a plurality of first retaining members equiangularly spaced around a bottom side thereof and fastened to said retaining portion of said packing cup.

18. The LED module as claimed in claim 17, further comprising an annular circuit board mounted on said bracket around the center opening of said bracket, and a plurality of electrodes electrically soldered to said annular circuit board and respectively electrically plugged into said tubular conducting terminals.

19. The LED module as claimed in claim 17, wherein said retaining portion of said packing cup is a retaining groove extending around the periphery of said packing cup; each said first retaining member of said bracket comprises a hooked portion for engaging the retaining groove of said retaining portion of said packing cup.

20. The LED module as claimed in claim 16, wherein said packing cup comprises an endless locating groove located on a bottom wall thereof around said circuit substrate, and a water seal ring positioned in said endless locating groove.

21. The LED module as claimed in claim 16, wherein said circuit substrate is selected from a group consisting of copper-based high conduction substrate, aluminum-based high conduction substrate, ferrite-based high conduction substrate and ceramics base copper-clad high conduction substrate.

* * * * *